US009648409B2

(12) United States Patent
Puskarich

(10) Patent No.: US 9,648,409 B2
(45) Date of Patent: May 9, 2017

(54) EARPHONES WITH EAR PRESENCE SENSORS

(75) Inventor: Paul G. Puskarich, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 957 days.

(21) Appl. No.: 13/547,371

(22) Filed: Jul. 12, 2012

(65) Prior Publication Data

US 2014/0016803 A1 Jan. 16, 2014

(51) Int. Cl.

| | |
|---|---|
| ***H04R 1/10*** | (2006.01) |
| ***H04R 3/00*** | (2006.01) |
| ***H04R 5/033*** | (2006.01) |
| ***H04R 5/04*** | (2006.01) |

(52) U.S. Cl.

CPC ..... *H04R 1/1041* (2013.01); *H04R 3/007* (2013.01); *H04R 5/033* (2013.01); *H04R 5/04* (2013.01); *H04R 2430/01* (2013.01); *H04R 2499/11* (2013.01)

(58) Field of Classification Search

CPC .. H04R 1/1041; H04R 25/02; H04R 2499/11; H04R 2430/01; H04R 5/033; H04R 5/04; H04R 3/007; H04M 1/6066; H04M 1/05; H04M 1/6058; H03K 17/955

USPC ..... 381/309, 74

See application file for complete search history.

(56) References Cited

U.S. PATENT DOCUMENTS 3,794,779 A * 2/1974 Greuzerd et al. ..... 381/5
3,796,840 A * 3/1974 Ohta ..... 381/5
5,144,678 A 9/1992 Lenz
5,337,353 A * 8/1994 Boie ..... G01D 5/2405 324/660
5,729,604 A 3/1998 Van Schyndel
5,937,070 A 8/1999 Todter et al.
(Continued)

FOREIGN PATENT DOCUMENTS

| | | |
|---|---|---|
| JP | 10028169 | 1/1998 |
| WO | 2011146659 | 11/2011 |

OTHER PUBLICATIONS

"Method and System is Disclosed for Modifying Audio Channel Routing Based on Operational Condition Associated with One or More Audio Devices," Jul. 16, 2010 (3 pages).

(Continued)

*Primary Examiner* — Md S Elahee
*Assistant Examiner* — Angelica M McKinney
(74) *Attorney, Agent, or Firm* — Treyz Law Group, P.C.; G. Victor Treyz; Zachary D. Hadd

(57) ABSTRACT

An electronic device may be coupled to an accessory such as a pair of earphones. The earphones may have ear presence sensor structures that determine whether or not the ears of a user are present in the vicinity of the earphones. The earphones may contain first and second speakers. When both the first and second speakers are located in the ears of the user, the electronic device may perform functions such as playing audio content. When one of the speakers has been removed from the ears of the user while the other of the speakers remains in the ears of the user, the electronic device can take actions such as pausing the playback of audio content, switching from stereo to monophonic playback, or stopping the playback of content. Suitable actions such as increasing audio drive strength may be taken when both speakers have been removed from the ears.

19 Claims, 6 Drawing Sheets

(56) References Cited

U.S. PATENT DOCUMENTS

| | | | | |
|---|---|---|---|---|
| 6,118,878 | A | 9/2000 | Jones | |
| 6,614,912 | B1 | 9/2003 | Yamada et al. | |
| 6,817,440 | B1 * | 11/2004 | Kim | H04R 1/1075 181/128 |
| 7,069,018 | B1 | 6/2006 | Granstam et al. | |
| 7,925,029 | B2 | 4/2011 | Hollemans | |
| 8,019,096 | B2 | 9/2011 | Sander et al. | |
| 8,199,956 | B2 | 6/2012 | Haartsen et al. | |
| 8,238,590 | B2 | 8/2012 | Burge | |
| 8,428,053 | B2 | 4/2013 | Kannappan | |
| 8,521,239 | B2 | 8/2013 | Hosoi et al. | |
| 8,954,177 | B2 | 2/2015 | Sanders | |
| 2004/0138723 | A1 * | 7/2004 | Malick et al. | 607/57 |
| 2005/0170859 | A1 | 8/2005 | Koike et al. | |
| 2005/0250553 | A1 | 11/2005 | Lim | |
| 2006/0013079 | A1 * | 1/2006 | Rekimoto | 369/30.01 |
| 2006/0233413 | A1 | 10/2006 | Nam | |
| 2006/0256133 | A1 | 11/2006 | Rosenberg | |
| 2007/0076897 | A1 * | 4/2007 | Philipp | H04R 1/1041 381/74 |
| 2007/0121959 | A1 | 5/2007 | Philipp | |
| 2007/0169615 | A1 | 7/2007 | Chidlaw et al. | |
| 2008/0157991 | A1 | 7/2008 | Raghunath et al. | |
| 2008/0158000 | A1 | 7/2008 | Mattrazzo | |
| 2008/0220831 | A1 * | 9/2008 | Alameh et al. | 455/575.2 |
| 2008/0303947 | A1 | 12/2008 | Ohnishi et al. | |
| 2009/0112696 | A1 | 4/2009 | Jung et al. | |
| 2009/0131124 | A1 | 5/2009 | Bibaud et al. | |
| 2009/0245549 | A1 * | 10/2009 | Jubelirer | H04R 1/1091 381/309 |
| 2009/0285408 | A1 | 11/2009 | Kimura | |
| 2010/0020998 | A1 | 1/2010 | Brown et al. | |
| 2010/0022283 | A1 | 1/2010 | Terlizzi | |
| 2010/0109895 | A1 * | 5/2010 | Rosener | H04M 1/05 340/686.1 |
| 2010/0128887 | A1 | 5/2010 | Lee et al. | |
| 2010/0183175 | A1 | 7/2010 | Chen et al. | |
| 2010/0197360 | A1 | 8/2010 | Namgoong et al. | |
| 2010/0310087 | A1 * | 12/2010 | Ishida | H04R 1/1041 381/74 |
| 2010/0310097 | A1 | 12/2010 | Chang | |
| 2011/0021182 | A1 | 1/2011 | Huan | |
| 2011/0116643 | A1 | 5/2011 | Tiscareno et al. | |
| 2011/0144779 | A1 | 6/2011 | Janse et al. | |
| 2011/0187868 | A1 * | 8/2011 | Chang et al. | 348/163 |
| 2011/0188677 | A1 * | 8/2011 | Rothkopf | H02J 7/00 381/150 |
| 2011/0196519 | A1 | 8/2011 | Khoury et al. | |
| 2011/0286615 | A1 | 11/2011 | Olodort et al. | |
| 2012/0086551 | A1 | 4/2012 | Lowe et al. | |
| 2012/0114154 | A1 * | 5/2012 | Abrahamsson | H04R 5/033 381/309 |
| 2012/0207317 | A1 | 8/2012 | Abdollahzadeh Milani et al. | |
| 2012/0230699 | A1 | 9/2012 | Burnett | |
| 2012/0244917 | A1 | 9/2012 | Hosoi | |
| 2013/0038458 | A1 | 2/2013 | Toivola | |
| 2013/0075595 | A1 * | 3/2013 | Ruh | 250/221 |
| 2013/0083933 | A1 | 4/2013 | Aase | |
| 2013/0094659 | A1 | 4/2013 | Liu | |
| 2013/0121494 | A1 | 5/2013 | Johnston | |
| 2013/0163783 | A1 * | 6/2013 | Burlingame | H03G 5/005 381/103 |
| 2013/0236027 | A1 | 9/2013 | Tao | |
| 2014/0146976 | A1 | 5/2014 | Rundle | |
| 2014/0146979 | A1 | 5/2014 | Puskarich | |
| 2014/0146982 | A1 | 5/2014 | Pelosi | |
| 2015/0358712 | A1 * | 12/2015 | Ji | H04R 1/1008 181/129 |

OTHER PUBLICATIONS

Acker et al., "Smart Audio Output With Presence Sensors: Enabling Mode Switching Using Head Sets or Ear Buds," Synaptics Incorporated, San Jose, California, Nov. 2, 2005 (10 pages).

"Automated Play/Pause of Music Based on Aggregated Sensor Data," Feb. 2, 2012 (3 pages).

Free on iPhone: Free Apps, Review for iPhone, "iPhone Proximity Sensor", posted Jan. 2, 2009, retrieved Sep. 1, 2011.

Hisahiro Moriuchi "Universal Earphones: Earphones with Automatic Side and Shared Use Detection", 2012, 1 page.

* cited by examiner

EARPHONES WITH EAR PRESENCE SENSORS

BACKGROUND

This relates to electronic devices and, more particularly, to electronic devices with accessories such as earphones.

Accessories such as earphones are often used with media players, cellular telephones, and other electronic devices. There can be difficulties associated with using earphones. For example, a user who is listening to audio content using earphones in both ears may occasionally need to remove one or both of the earphones. When doing so, the user may miss content that is being played. For example, if a user needs to momentarily remove earphones to talk to someone, the user may not be able to manually stop content playback before removing the earphones, causing some of the content to be played back without the user's full attention.

It would therefore be desirable to be able to provide improved ways in which to control operation of an electronic device coupled to an accessory.

SUMMARY

An electronic device may be coupled to an accessory such as a pair of earphones. The earphones may have ear presence sensor structures that determine whether or not the ears of a user are present in the vicinity of the earphones.

The earphones may contain first and second speakers. For example, the earphones may include a left earbud and a right earbud. When both the first and second speakers are located in the ears of the user, the electronic device may perform functions such as playing audio content. The audio content may be played in stereo using an audio signal strength appropriate for use when the speakers are located in the vicinity of the ears of the user.

When one of the speakers has been removed from the ears of the user while the other of the speakers remains in the ears of the user, the electronic device can take actions such as pausing the playback of audio content, switching from stereo to monophonic playback, or stopping the playback of content.

Suitable actions such as increasing audio signal strength may be taken when both speakers have been removed from the ears of the user.

Ear presence sensor structures may be formed from electrode structures. The electrode structures may be used to measure electrical resistance or capacitance. The electrode structures may be formed from a conductive mesh through which audio may pass.

Further features of the invention, its nature and various advantages will be more apparent from the accompanying drawings and the following detailed description of the preferred embodiments.

DETAILED DESCRIPTION

Electronic device accessories may be provided with the ability to sense the presence of external objects. For example, an earphone accessory may be provided with sensing structures that can determine whether or not the earphones (i.e., the earphone speakers) are located in the ears of a user.

Figure 1:
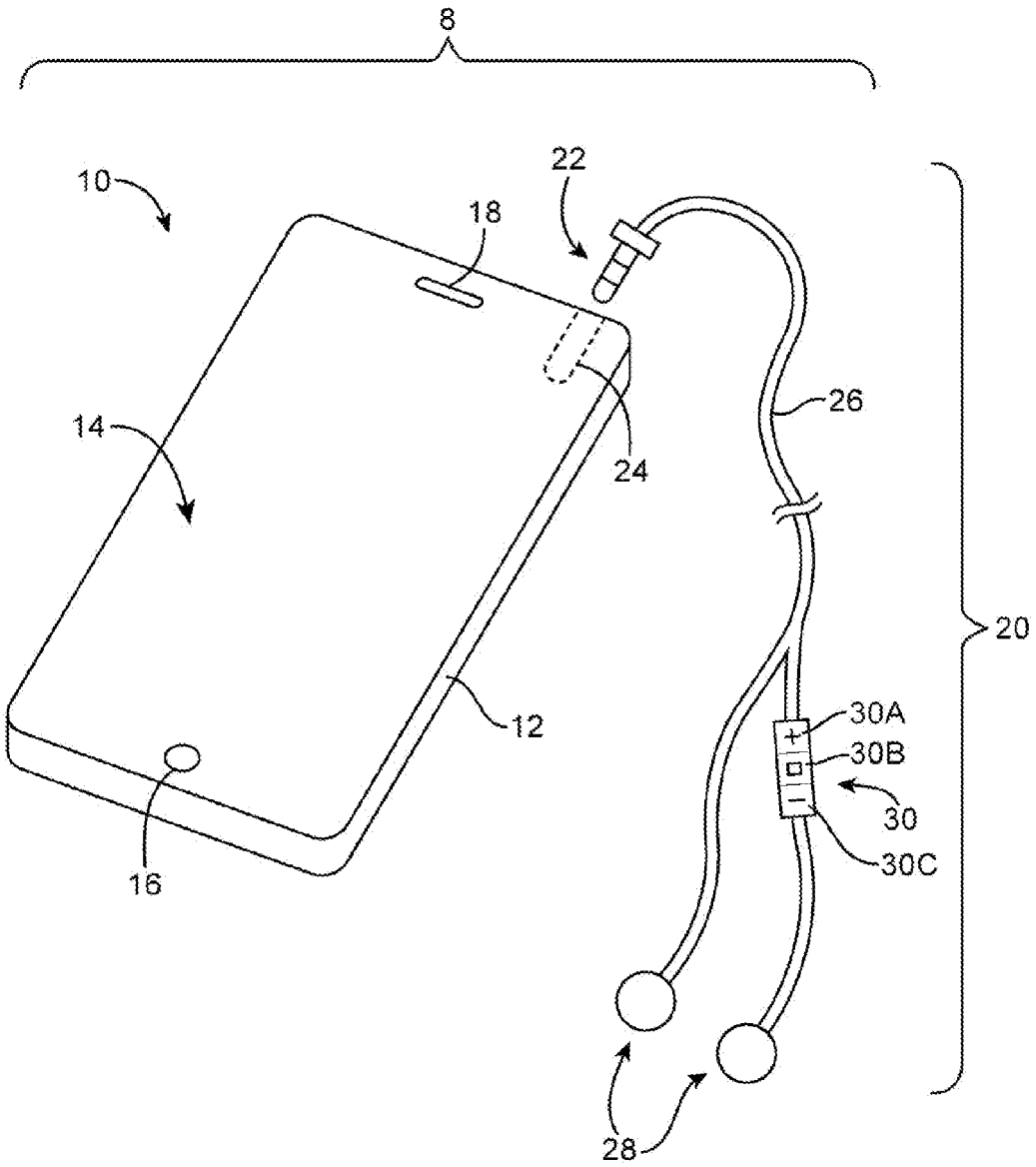
FIG. 1 is a front perspective view of an illustrative electronic device and associated accessory in accordance with an embodiment of the present invention.

FIG. 1 is a diagram of a system of the type that may be provided with an accessory having sensing structures for detecting the presence of external objects such as the ears of a user. As shown in FIG. 1, system 8 may include electronic device 10 and accessory 20.

Electronic device 10 may include a display such as display 14. Display 14 may be a touch screen that incorporates a layer of conductive capacitive touch sensor electrodes or other touch sensor components or may be a display that is not touch-sensitive. Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies. Configurations in which display 14 includes display layers that form liquid crystal display (LCD) pixels may sometimes be described herein as an example. This is, however, merely illustrative. Display 14 may include display pixels formed using any suitable type of display technology.

Display 14 may be protected using a display cover layer such as a layer of transparent glass or clear plastic. Openings may be formed in the display cover layer. For example, an opening may be formed in the display cover layer to accommodate a button such as button 16 and an opening such as opening 18 may be used to form a speaker port.

Device 10 may have a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials.

Housing 12 may be formed using a unibody configuration in which some or all of housing 12 is machined or molded as a single structure or may be formed using multiple structures (e.g., an internal frame structure, one or more structures that form exterior housing surfaces, etc.). The periphery of housing 12 may, if desired, include walls. One or more openings may be formed in housing 12 to accommodate connector ports, buttons, and other components. For example, an opening may be formed in the wall of housing 12 to accommodate audio connector 24 and other connectors (e.g., digital data port connectors, etc.). Audio connector 24 may be a female audio connector (sometimes referred to as an audio jack) that has two pins (contacts), three pins, four pins, or more than four pins (as examples). Audio connector 24 may mate with male audio connector 22 (sometimes referred to as an audio plug) in accessory 20.

Accessory 10 may be a pair of earphones (e.g., earbuds or earphones with other types of speakers), other audio equipment (e.g., an audio device with a single earbud unit), or other electronic equipment that communicates with electronic device 10. The use of a pair of headphones in system 8 is sometimes described herein as an example. This is, however, merely illustrative. Accessory 10 may be implemented using any suitable electronic equipment.

As shown in FIG. 1, accessory 20 may include a communications path such as cable 26 that is coupled to audio plug 22. Cable 26 may contain conductive lines (e.g., wires) that are coupled to respective contacts (pins) in audio connector 22. The conductive lines of cable 26 may be used to route audio signals from device 10 to speakers in earphone units 28. Earphone units 28 (which may sometimes be referred to as speakers or earphone housings) may include sensor structures for determining when earphone units 28 have been placed within the ears of a user. Microphone signals may be gathered using a microphone mounted in controller unit 30. Controller unit 30 may also have buttons that receive user input from a user of system 8. A user may, for example, manually control the playback of media by pressing button 30A to play media or increase audio volume, by pressing button 30B to pause or stop media playback, and by pressing button 30C to reverse media playback or decrease audio volume (as examples).

The circuitry of controller 30 may communicate with the circuitry of device 10 using the wires or other conductive paths in cable 26 (e.g., using digital and/or analog communications signals). The paths in cable 26 may also be coupled to speaker drivers in earphones 28, so that audio signals from device 10 may be played through the speakers in earbuds 28. Electronic device 10 may regulate the volume of sound produced by earbuds 28 by controlling the audio signal strength used in driving the speakers in earbuds 28.

Sensor signals from sensor structures in earbuds 28 may be conveyed to device 10 using the conductive paths of cable 26. Electronic device 10 may process the sensor signals and take suitable action based on a determination of whether or not one or both of earphones 28 is in use in a user's ears.

Figure 2:
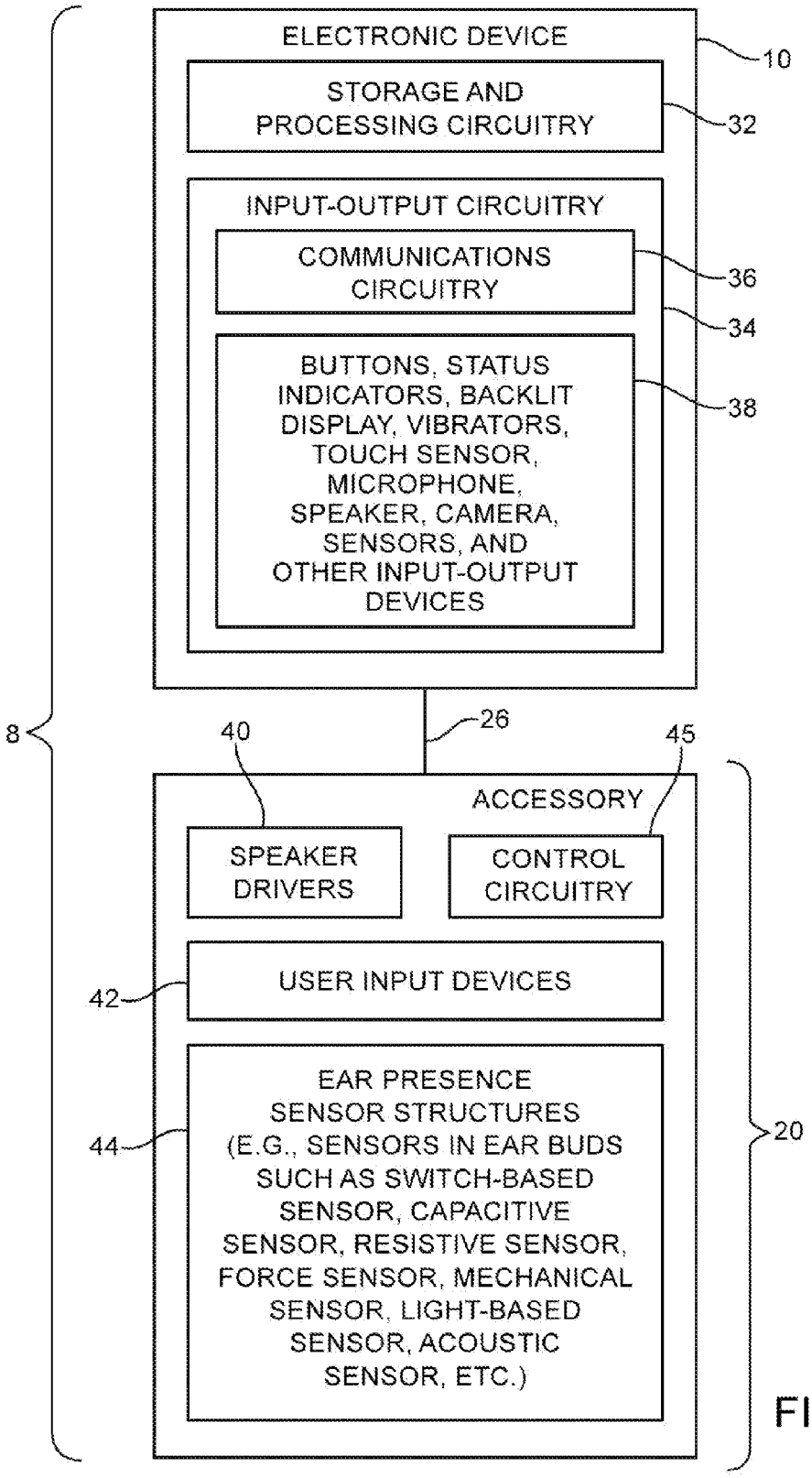
FIG. 2 is a schematic diagram of an illustrative electronic device in accordance with an embodiment of the present invention.

A schematic diagram showing illustrative components that may be used in device 10 and accessory 20 of system 8 is shown in FIG. 2. As shown in FIG. 2, electronic device 10 may include control circuitry 32 and input-output circuitry 34. Control circuitry 32 may include storage and processing circuitry that is configured to execute software that controls the operation of device 10. Control circuitry 32 may be implemented using one or more integrated circuits such as microprocessors, application specific integrated circuits, memory, and other storage and processing circuitry.

Input-output circuitry 34 may include components for receiving input from external equipment and for supplying output. For example, input-output circuitry 34 may include user interface components for providing a user of device 10 with output and for gathering input from a user. As shown in FIG. 2, input-output circuitry 34 may include communications circuitry 36. Communications circuitry 36 may include wireless circuitry such as radio-frequency transceiver circuitry with a radio-frequency receiver and/or a radio-frequency transmitter. Radio-frequency transceiver circuitry in the wireless circuitry may be used to handle wireless signals in communications bands such as the 2.4 GHz and 5 GHz WiFi® bands, cellular telephone bands, and other wireless communications frequencies of interest. Communications circuitry 36 may also include wired communications circuitry such as circuitry for communicating with external equipment over serial and/or parallel digital data paths.

Input-output devices 38 may include buttons such as sliding switches, push buttons, menu buttons, buttons based on dome switches, keys on a keypad or keyboard, or other switch-based structures. Input-output devices 38 may also include status indicator lights, vibrators, display touch sensors, speakers, microphones, camera sensors, ambient light sensors, proximity sensors, and other input-output structures.

Electronic device 10 may be coupled to components in accessory 20 using cables such as cable 26 of accessory 20. Accessory 20 may include speakers such as a pair of speaker drivers 40 (e.g., a left speaker and a right speaker). If desired, accessory 20 may include more than one driver per earbud. For example, each earbud in accessory 20 may have a tweeter, a midrange driver, and a bass driver (as an example). Speaker drivers 40 may be mounted in earbuds or other earphone housings. The use of left and right earbuds to house respective left and right speaker drivers 40 is sometimes described herein as an example.

If desired, accessory 20 may include user input devices 42 such as buttons (see, e.g., the buttons associated with button controller 30 of FIG. 1), touch-based input devices (e.g., touch screens, touch pads, touch buttons), a microphone to gather voice input, and other user input devices.

To determine whether or not the earbuds in which speaker drivers 40 have been mounted are located in the ears of a user, accessory 20 may be provided with ear presence sensor structures 44. Ear presence sensor structures 44 may be configured to detect whether or not the earbuds (or other earphone units of accessory 20) have been placed in the ears of a user. Ear presence sensors may be formed from force sensors, from switches or other mechanical sensors, from capacitive sensors, from resistance-based sensors, from light-based sensors, and from acoustic-based sensors such as ultrasonic acoustic-based sensors (as examples). Control circuitry 45 in accessory 20 (e.g., storage and processing circuits formed from one or more integrated circuits or other circuitry) and/or control circuitry 32 of electronic device 10 may use information from ear presence sensor structures 44 in determining which actions should be automatically taken by device 10.

Figure 3:
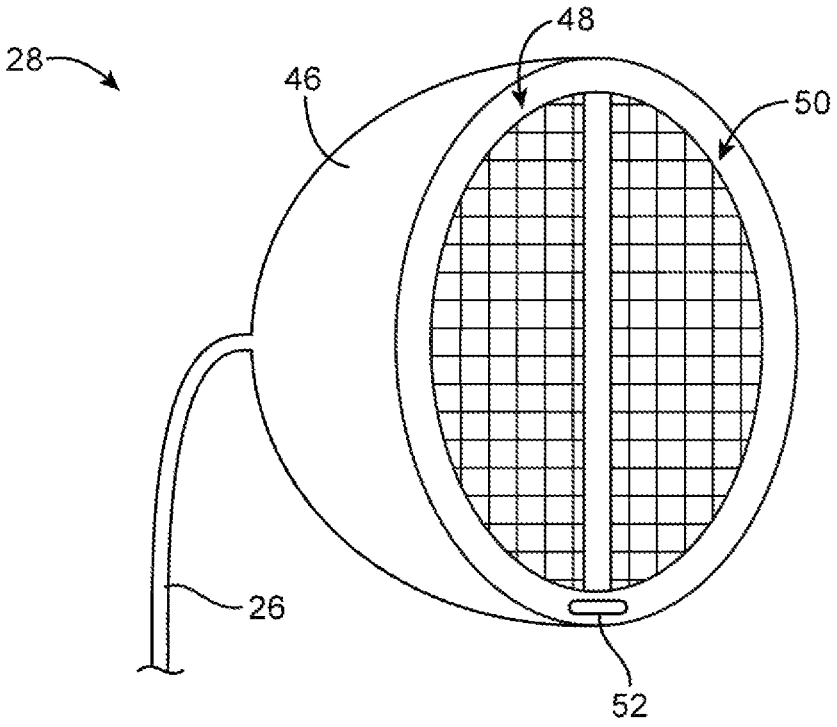
FIG. 3 is a perspective view of an illustrative earphone housing in an accessory in accordance with an embodiment of the present invention.

An illustrative earbud with an ear presence sensor is shown in FIG. 3. In the example of FIG. 3, earbud 28 has a housing such as housing 46 in which one or more speaker drivers such as speakers 40 of FIG. 2 are mounted. If desired, an auxiliary speaker such as speaker 52 may be mounted on the outside of housing 46 (e.g., to serve as a supplemental speaker for producing loud sounds when earbud 28 is not in the ear of a user). The supplemental speaker can be used to play back the same audio channel that is being played back by speakers 40 or may be used to support a multi-channel audio mode. For example, speakers 40 may be used to play bass and mid-range channel information (e.g., audio in a first frequency range), whereas supplemental speakers 52 may be used to play tweeter information (e.g., audio in a second frequency range that is higher than the first frequency range). As another example, speakers 40 may play right and left stereo information (and center channel information) and supplemental speakers 52 may play surround channel information.

Conductive structures such as conductive mesh structures 48 and 50 may be mounted in housing 46. As shown in FIG. 3, for example, mesh structures 48 and 50 may be mounted in the front of housing 46 so that sound from the speakers inside earbud housing 46 may pass through the holes of the mesh. If desired, earbud 28 may contain microphone structures (e.g., when implementing noise cancellation features in earbud 28). The use of mesh when forming electrode structures 48 and 50 may allow ambient sound to be picked up by the noise cancellation microphones in housing 26.

Mesh electrodes 48 and 50 (e.g., metal screen structures) or other conductive structures in earbud 28 may be used as first and second terminals in a resistive (resistance-based) sensor. Control circuitry in housing 46 may be used to apply a voltage across the first and second terminals while measuring how much current flows as a result. The control circuitry may use information on the voltage and current signals that are established between electrodes 48 and 50 to determine whether or not earbud 28 has been placed in the ear of a user. In the absence of the user's ear, the resistance between electrodes 48 and 50 will be relatively high. When, however, earbud 28 has been placed into a user's ear, contact between electrodes 48 and 50 and the flesh of the ear will give rise to a lower resistance path between electrodes 48 and 50. To determine whether or not earbud 28 has been placed within the user's ear, the control circuitry of earbud 28 (and/or control circuitry 32 of FIG. 2) may measure the resistance between electrodes 48 and 50 and may compare the measured resistance to a predetermined threshold. When the measured resistance is below the predetermined threshold, device 10 can conclude that earbud 28 has been placed in the ear of the user. When the measured resistance exceeds the predetermined threshold, device 10 can conclude that earbud 28 is out of the ear.

In addition to or instead of using mesh 48 and 50 to measure the resistance of the user's ear, mesh electrodes 48 and 50 may be used as capacitive sensor electrodes (e.g., to make mutual capacitance measurements or to make self capacitance measurements). Different capacitance values may be detected in the presence and absence of the user's ear in the vicinity of electrodes 48 and 50. This allows device 10 to use the capacitance measurements to determine whether or not earbud 28 is in or out of the user's ear.

Figure 4:
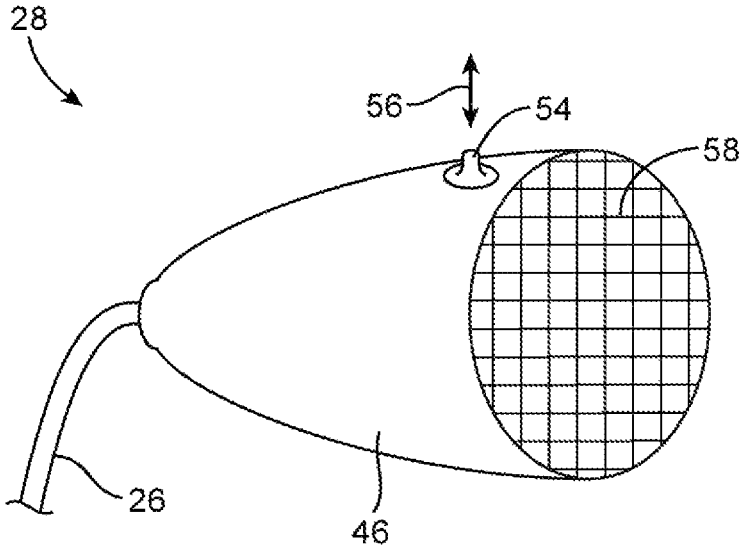
FIG. 4 is a perspective view of an illustrative earphone housing that has an ear presence sensor such as a switch in accordance with an embodiment of the present invention.

If desired, earbud 28 may be provided with a switch-based ear presence detector. As shown in FIG. 4, for example, switch 54 may be mounted on an exterior surface of earbud housing 46. Speaker mesh 58 may be mounted on the front of housing 46. Speaker drivers may be mounted within the interior of housing 46. During operation of earbud 28, sound may pass through openings in speaker mesh 58. Switch 54 may move up and down in directions 56. When earbud 28 is inserted in an ear of a user, switch 54 may be compressed inward. When earbud 28 is out of the user's ear, switch 54 may move outwards to regain its original uncompressed state. Device 10 may use information from switch structures such as switch 54 to determine whether or not earbud 28 has been placed in the ear of a user.

Figure 5:
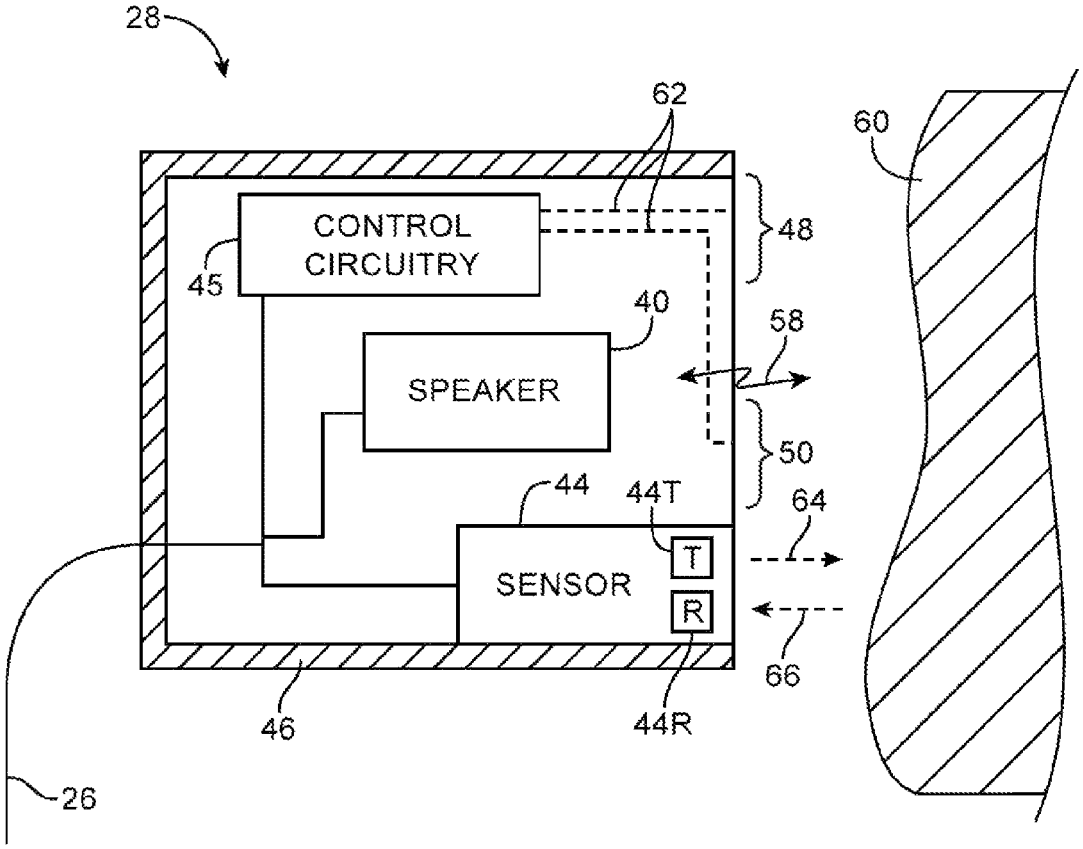
FIG. 5 is a cross-sectional side view of an earphone housing of the type that may be provided with sensor structures for detecting the presence of an ear or other external object in accordance with an embodiment of the present invention.

A cross-sectional side view of an illustrative earbud with a speaker driver and an associated ear presence sensor is shown in FIG. 5. As shown in FIG. 5, earbud 28 may have a housing such as housing 46. Speaker 40 may be mounted within housing 46 overlapping an acoustic grill formed from structures such as mesh 48 and 50 or other acoustic mesh. During operation, sound 58 may pass through the acoustic mesh. For example, speaker 40 may produce sound that is received by a user's ear or other external object 60.

When external object 60 is sufficiently close to earbud 28, the presence of external object 60 may be detected. For example, control circuitry 45 may measure the resistance between mesh electrodes 48 and 50 using conductive paths 62 or may use capacitance measurements in monitoring for the presence of object 60. The measured resistance (or capacitance) may then be used to determine whether earbud 28 is in the user's ear or is out of the user's ear. Control circuitry 45 may also use sensors such as sensor 44 of FIG. 5 to monitor for the presence or absence of external objects such as the user's ear. As shown in FIG. 5, sensor 44 may have a transmitter such as transmitter 44T and may have a receiver such as receiver 44R. During operation of sensor 44, sensor 44 may transmit signals such as signal 64 and may gather reflected signals such as signal 66. The strength of received signal 66 may be used to measure whether or not external object 60 is in the presence of earbud 28.

Sensor 44 may be a light-based sensor. For example, transmitter 44T may be a light-emitting diode or laser that emits light 64 (e.g., infrared light, visible light, etc.) and receiver 44R may be a light detector (e.g., a photodiode or phototransistor) that measures the amount of light 64 that is reflected as reflected light 66 from external object 60. When the amount of light that is reflected from external object 60 is high, device 10 can conclude that earbud 28 is in the user's ear. When the amount of light that is reflected from external object 60 is low, device 10 can conclude that earbud 28 is out of the user's ear.

If desired, sensor 44 may be a sensor that emits and receives acoustic signals. For example, transmitter 44T may be an ultrasonic signal transducer that transmits ultrasonic signals 64. Receiver 44R may be an ultrasonic signal receiver that measures the amount of corresponding ultrasonic signal 66 that is reflected from external object 60. When the amount of ultrasonic signal that is reflected from external object 60 is low, device 10 can conclude that earbud 28 is not in the user's ear. When the amount of ultrasonic signal that is reflected from external object 60 is high, device 10 can conclude that earbud 28 is currently in the user's ear.

In force-based sensor schemes, the resistance of a compressible foam may be measured or a strain gauge output can be monitored. When force is present, electronic device 10 can conclude that earbud 28 has been inserted into a user's ear, whereas when force is not present, electronic device 10 can conclude that earbud 28 has remained outside of the user's ear. Force indicative of a user's ear pressing against earbud 28 may also be monitored using piezo-electric force sensors or other force sensors.

Figure 6:
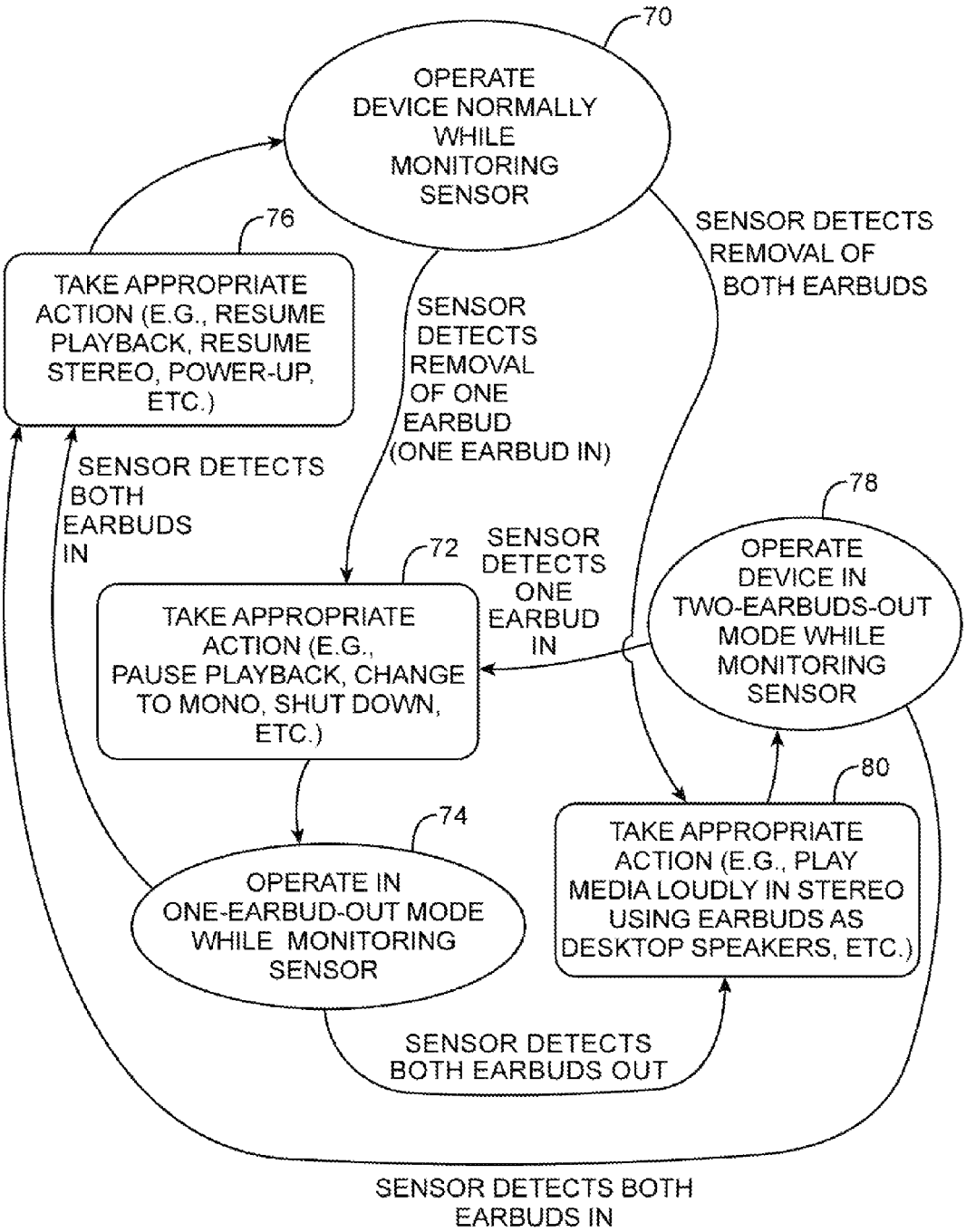
FIG. 6 is a flow chart of illustrative steps involved in using an accessory and electronic device in accordance with an embodiment of the present invention.

FIG. 6 is a flow chart of illustrative steps involved in using system 8. During the operations of step 70, earbuds 28 may be located in the ears of a user and device 10 may be operated normally while using sensor circuitry 44 to monitor for the presence or absence of each earbud 28 of accessory 20 within the ears of a user. Circuitry 32 (and/or circuitry 45, if desired) may be used in evaluating sensor data and taking appropriate action. Configurations in which control circuitry 32 is used in taking action based on sensor data are sometimes described herein as an example.

Examples of operations that may be performed by device 10 during step 70 include audio-based operations such as playing media content using an audio signal strength that results in a playback volume that is appropriate for listening through earbuds 28, providing a user with audio associated with a telephone call, providing audio associated with a video chat session to the user, or otherwise presenting audio content through earbuds 28. Audio may be played in stereo so that left and right earbuds receive corresponding left and right channels of audio, may be played using a multi-channel surround sound scheme, or may be played using a monophonic (mono) sound scheme in which both the left and right channels of audio are identical.

During the monitoring operation of step 70, device 10 can use ear presence detectors 44 to determine whether or not earbuds 28 remain within the user's ears. If it is determined that one of the earbuds has been removed so that only a single earbud remains in the ear of a user, device 10 can take appropriate action at step 72. For example, in response to determining that only one earbud remains in the user's ear, control circuitry 45 and/or 32 may automatically switch the type audio playback scheme that is being used from multi-channel or stereo sound to mono sound. Because only one earbud is being actively used, the use of a stereo playback scheme no longer is appropriate and could cause the user to miss information that is being sent to the channel associated with the absent earbud. As another example, if device 10 was playing music files, was playing video that includes audio, or was playing other audio content to the user, detection of removal of one earbud from the user's ear may indicate that the user has removed the earbud to allow the user to be able to better hear sounds in the user's environment (e.g., to converse with someone). Accordingly, in response to detection of removal of one of the earbuds from the user's ear, device 10 may automatically pause audio playback. Playback may also be completely stopped by device 10 (e.g., by control circuitry 32) in response to detection of earbud removal (i.e., device 10 may perform the same type of stopping operation that would be performed in response to user selection of an on-screen stop option or user actuation of a stop button). Other actions may be taken in response to detection of removal of one earbud from the user's ear, if desired. These examples are merely illustrative.

Following the operations of step 72, control circuitry 30 may, at step 74 operate device 10 in a one-earbud-in mode while using ear presence detectors to monitor the state of each earbud. In particular, device 10 may operate in a mono audio mode or may operate in a mode in which audio playback has been paused or stopped (as examples). While operating device 10 in a one-earbud-in mode, control circuitry 32 and/or 45 may use ear presence sensor structures 44 to monitor for changes in the status of earbuds 28. If, during the operations of step 74, device 10 senses that the removed earbud has been returned to the user's ear so that both earbuds are inserted in the user's ears, appropriate action may be taken at step 76. For example, device 10 may switch the audio mode from mono to stereo (or other multi-channel audio mode), device 10 may resume the playback of paused or stopped audio content, etc. Operations may then proceed to step 70, where device 10 may operate in a two-earbud-in mode while monitoring ear presence sensor structures 44 to determine whether one or both earbuds have been removed from the user's ears.

If, during the operations of step 70, it is determined that both the left and right earbuds have been removed from the user's ears, device 10 may take suitable action at step 80. For example, in response to detecting that both earbuds are out of the user's ears, device 10 may conclude that the user is interested in using earbuds 28 as desk-top speakers. Because ear presence sensor structures 44 have confirmed that neither earbud is in the user's ear, device 10 can safely increase playback volume (i.e., audio signal drive strength) through the speakers to a loud level (e.g., a level that is in excess of a comfortable listening level for use when earbuds 28 are in the user's ears and that is sufficient to allow earbuds 28 to be used as regular non-earbud out-of-ear speakers). Both earbuds are in the same out-of-ear state, so audio may be played in stereo or other multi-channel formats may be used. As another example, device 10 can conclude that the user has removed earbuds 28 from the user's ear because the user temporarily is interested to listening to sounds in the user's surroundings and not the media that is being played through the earbuds. Device 10 can therefore pause or stop media playback.

After taking suitable actions at step 80, device 10 can be operated in a two-earbuds-out mode (step 78). For example, device 10 may use earbuds 28 as desktop speakers by playing music through earbuds 28 at a volume (audio signal drive strength) sufficient to be listened to comfortably by the user and potentially other listeners in the vicinity of earbuds 28 (i.e., at a normal music playback volume). If desired, an auxiliary speaker such as speaker 52 of FIG. 3 may be used as a supplemental speaker during audio playback in the two-earbuds-out mode. Supplemental speakers 52 may be used in playing multi-channel audio or may be used in playing high frequency audio or audio in another frequency range. As another example, device 10 may operate with paused or stopped audio playback during step 78.

During the operations of step 78, ear presence sensor structures 44 may be used to monitor for the presence of earbuds 28 in the ears of the user. If it is determined that one of the earbuds has been placed in the ear of the user, appropriate actions may be taken at step 72. For example, if device 10 was using earbuds 28 as desktop speakers by playing stereo audio loudly through earbuds 28 using a relatively high audio signal drive strength, device 10 may reduce the audio signal drive strength to a low level so that playback volume is reduced to a volume level that is acceptable for use of an earbud in the user's ear. Device 10 may also switch to a mono playback mode. If, during the operations of step 78, ear presence sensor structures 44 determine that both earbuds have been placed in the user's ears, appropriate action may be taken at step 76. For example, if device 10 was using earbuds 28 as desktop speakers, device 10 may reduce audio signal strength and therefore playback volume sufficiently to allow earbuds 28 to be safely used in the user's ears.

During the operations of step 74, sensor structures 44 may detect that both earbuds have been removed from the user's ears. In this situation, device 10 may take appropriate action at step 80. For example, device 10 may conclude that earbuds 28 are both not in the user's ears so that earbuds 28 may be safely used as desktop speakers. Playback volume may therefore be increased.

If desired, different audio amplifiers may be used for playback during earbud-in modes and earbud-out modes. For example, a low power audio amplifier that uses a low audio signal strength may be used to play audio through earbuds 28 when earbuds 28 are in the ears of the user and a high power audio amplifier that uses a high audio signal strength may be used by device 10 to play audio through earbuds 28 when earbuds 28 are both out of the user's ears.

The foregoing is merely illustrative of the principles of this invention and various modifications can be made by those skilled in the art without departing from the scope and spirit of the invention. The foregoing embodiments may be implemented individually or in any combination.

What is claimed is:

1. A method for operating an electronic device that is configured to play audio through a pair of earphones, comprising:

with control circuitry in the electronic device, gathering information from ear presence sensor structures in the earphones on whether the earphones are in the ears of a user of the electronic device, wherein gathering the information comprises gathering information from light-based sensor structures having at least one light source and at least one light detector that detects light emitted by the at least one light source when a user's ear is present adjacent to at least one of the earphones; and in response to the information from the ear presence sensor structures, adjusting audio playback from the control circuitry to the earphones.

2. The method defined in claim 1 further comprising:

playing stereo audio for the user with the earphones, wherein adjusting the audio playback comprises switching to a monophonic audio playback mode.

3. The method defined in claim 1 wherein the information indicates that the earphones are not in the ears of the user and wherein adjusting the audio playback comprises adjusting an audio signal strength provided to the earphones in response to determining that the earphones are not in the ears of the user.

4. The method defined in claim 1 wherein adjusting the audio playback comprises adjusting audio signal strength provided to the earphones in response to the information from the ear presence sensor structures, the method further comprising:

playing audio using a stereo audio playback mode when the earphones are in the ears of the user, wherein adjusting the audio playback further comprises playing the audio using a monophonic audio playback mode.

5. The method defined in claim 1 wherein the earphones include first and second earbuds and wherein adjusting the audio playback comprises:

playing audio using a monophonic audio playback mode the information indicates that the first earbud in the earphones is not in an ear of the user and the second earbud is in the ear of the user; and playing audio using a stereo audio playback mode the information indicates that the first earbud in the earphones is in an ear of the user and the second earbud is in the ear of the user.

6. The method defined in claim 1 wherein the earphone has a first earphone unit and a second earphone unit, wherein the information indicates that the first earphone unit is in the ears of the user and that the second earphone unit is not in the ears of the user, and wherein adjusting the audio playback comprises pausing the audio playback in response to determining that the second earphone unit has been removed from the ears of the user.

7. The method defined in claim 1 wherein the earphone has a first earphone unit and a second earphone unit, wherein the information indicates that the first earphone unit is in the ears of the user and that the second earphone unit is not in the ears of the user, and wherein adjusting the audio playback comprises stopping the audio playback in response to determining that the second earphone unit has been removed from the ears of the user.

8. The method defined in claim 1 wherein the earphones include first and second earbuds and wherein the information indicates that the second earbud has been removed from the ears of the user while the first earbud remains in the ears of the user, the method further comprising playing audio using the first and second earbuds when both the first and second earbuds are in the ears of the user, wherein adjusting the audio playback comprises:

in response to determining that the second earbud has been removed from the ears of the user while the first earbud remains in the ears of the user, pausing playback of the audio.

9. The method defined in claim 2 further comprising:

playing audio using a first audio signal strength when the earphones are in the ears of the user, wherein adjusting the audio playback comprises playing the audio using a second audio signal strength that is greater than the first audio signal strength.

10. The method defined in claim 5 wherein gathering the information comprises measuring capacitance signals using conductive electrodes in the earphones.

11. An electronic device accessory, comprising:

an audio connector that is adapted to mate with a mating audio connector in an electronic device;

a cable coupled to the audio connector;

left and right earphone housings;

left and right speaker drivers coupled to the cable, wherein the left speaker driver is mounted in the left earphone housing and wherein the right speaker driver is mounted in the right earphone housing; and ear presence sensor structures attached to the left and right earphone housings, wherein the ear presence sensor structures comprise light-based sensor structures having at least one light source and at least one light detector that detects light emitted by the at least one light source when a user's ear is present adjacent to at least one of the left and right earphone housings.

12. A method for operating a pair of headphones having speaker housings, comprising:

with ear presence sensor structures on the speaker housings, determining whether ears of a user are present adjacent to the speaker housings, wherein the ear presence sensor structures comprise a light emitter and a light receiver, and wherein the ear presence sensor structures determine that the ears of the user are present adjacent to the speaker housings in response to the light receiver receiving light emitted by the light detector; and adjusting audio playback to speakers in the speaker housings in response to determining whether the ears of the user are present adjacent to the speaker housings.

13. The method defined in claim 12 wherein the speaker housings include a left housing that has a left speaker and a left ear presence sensor and a right housing that has a right speaker and a right ear presence sensor and wherein determining whether the ears of the user are present adjacent to the speaker housings comprises determining that the right speaker is in the ears of the user while the left speaker is out of the ears of the user.

14. The method defined in claim 12 wherein the speaker housings include a left housing that has a left speaker and a left ear presence sensor and a right housing that has a right speaker and a right ear presence sensor and wherein the left housing includes a first supplemental speaker and wherein the right housing includes a second supplemental speaker, the method further comprising:

playing audio through the first and second supplemental speakers and through the left speaker and the right speaker in response to determining with the ear presence sensor structures that the ears of the user are not adjacent to the speaker housings.

15. The method defined in claim 14 wherein playing the audio comprises playing the audio in a first frequency range through the left speaker and the right speaker and playing the audio in a second frequency range that is higher than the first frequency range through the first and second supplemental speakers.

16. An electronic device, comprising:

an earphone housing;

a speaker mounted in the earphone housing; and a light-based ear presence sensor structure attached to the earphone housing, wherein the light-based ear presence sensor structure comprises a light source and a light detector, and wherein the light-based ear presence sensor structure detects that a user's ear is present adjacent to the earphone housing in response to the light detector receiving light emitted by the light source.

17. The electronic device defined in claim 16, further comprising:

control circuitry mounted in the earphone housing that receives information from the light-based ear presence sensor structure.

18. The electronic device defined in claim 16, wherein the light source emits infrared light.

19. The electronic device defined in claim 17, wherein the control circuitry adjusts audio playback through the speaker in response to information from the light-based ear presence sensor structure indicating that the user's ear is present adjacent to the earphone housing.

* * * * *